US010954731B2

(12) United States Patent
King et al.

(10) Patent No.: US 10,954,731 B2
(45) Date of Patent: Mar. 23, 2021

(54) FOAM CAP DRILLING METHODS

(71) Applicants: Gregory King, Aberdeen (GB); Kaustubh S. Kulkarni, Spring, TX (US); Sai S. Rao, Spring, TX (US); Andrey A. Troshko, Spring, TX (US)

(72) Inventors: Gregory King, Aberdeen (GB); Kaustubh S. Kulkarni, Spring, TX (US); Sai S. Rao, Spring, TX (US); Andrey A. Troshko, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 54 days.

(21) Appl. No.: 16/283,097

(22) Filed: Feb. 22, 2019

(65) Prior Publication Data

US 2019/0330942 A1 Oct. 31, 2019

Related U.S. Application Data

(60) Provisional application No. 62/690,672, filed on Jun. 27, 2018, provisional application No. 62/662,454, filed on Apr. 25, 2018.

(51) Int. Cl.

| | |
|---|---|
| ***E21B 21/14*** | (2006.01) |
| ***E21B 47/06*** | (2012.01) |
| ***E21B 47/10*** | (2012.01) |
| *E21B 21/00* | (2006.01) |

(52) U.S. Cl.

CPC ..... *E21B 21/14* (2013.01); *E21B 47/06* (2013.01); *E21B 47/10* (2013.01); *E21B 21/003* (2013.01)

(58) Field of Classification Search

CPC ..... E21B 21/003; E21B 21/14; E21B 47/06; E21B 47/10; E21B 21/00; E21B 21/08

See application file for complete search history.

(56) References Cited

U.S. PATENT DOCUMENTS 3,130,798 A * 4/1964 Schramm ..... C09K 8/38 175/69
3,889,764 A 6/1975 Jackson
4,615,564 A * 10/1986 Garrett ..... E21B 21/14 175/71

(Continued)

FOREIGN PATENT DOCUMENTS

GB 1248355 A 9/1971

OTHER PUBLICATIONS

Bacon et al. (2016) MPD Dynamic Influx Control Mitigates Conventional Well Control Pitfalls, SPE-179185-MS, Society of Petroleum Engineers Conference Paper, pp. 1-21.

(Continued)

*Primary Examiner* — Daniel P Stephenson
(74) *Attorney, Agent, or Firm* — ExxonMobil Upstream Research Company—Law Department

(57) ABSTRACT

A method for conducting a wellbore operation includes drilling a wellbore through one or more hydrocarbon bearing subterranean formations with a drill bit arranged at an end of a drill string, wherein an annulus is defined between the drill string and an inner wall of the wellbore. A foam is generated with a foam generator of an annular injection system in communication with the annulus, and the foam is introduced into the annulus with the annular injection system.

20 Claims, 3 Drawing Sheets

(56) References Cited

U.S. PATENT DOCUMENTS

| | | | | |
|---|---|---|---|---|
| 4,730,676 | A * | 3/1988 | Luers | B01F 3/04446 166/309 |
| 5,255,741 | A | 10/1993 | Alexander | |
| 5,716,910 | A * | 2/1998 | Totten | B01F 17/0085 507/102 |
| 2003/0146001 | A1* | 8/2003 | Hosie | E21B 4/02 166/369 |
| 2004/0110643 | A1* | 6/2004 | Zevallos | C09K 8/38 507/100 |
| 2004/0129424 | A1* | 7/2004 | Hosie | E21B 47/10 166/332.8 |
| 2006/0157282 | A1 | 7/2006 | Tilton | |
| 2007/0193778 | A1 | 8/2007 | Wooten | |
| 2019/0330942 | A1* | 10/2019 | King | E21B 47/10 |
| 2019/0336885 | A1* | 11/2019 | Ross | B04B 1/20 |

OTHER PUBLICATIONS

Dharma et al. (2008) Managed-Pressure Drilling and Downhole Isolation Technologies Deliver High Rate Gas Wells, SPE/IADC 114703, Society of Petroleum Engineers—SPE/IADC Managed Pressure Drilling and Underbalanced Operations Conference and Exhibition 2008, pp. 1-11.

Edrisi et al. (2015) New Foam Drilling Hydraulics Calculations by Using Two Foam Flow Regimes, SPE-174769-MS, Proceedings—SPE Annual Technical Conference and Exhibition, Jan. 2015, pp. 1-25.

Liu et al. (2013) Flammability Limits of Diesel and air Mixture for use in Underbalanced Drilling, SPE-165398-MS, Society of Petroleum Engineers—SPE Heavy Oil Conference Canada 2013, pp. 1-12.

Mykytiw et al. (2004) Practical Use of a Multiphase Flow Simulator for Underbalanced Drilling Applications Design - the tricks of the trade, SPE/IADC 91598, Blade Energy Partners, SPE/IADC Underbalanced Technology Conference and Exhibition—Proceedings, pp. 1-10.

Na et al. (2015) Imaging of gas-liquid annular flows for underbalanced drilling using electrical resistance tomography, Flow Measurement and Instrumentation, 46, pp. 319-316.

Osgouei, et al. (2015) Pressure drop estimation in horizontal annuli for liquid-gas 2 phase flow: Comparison of mechanistic models and computational intelligence techniques, Computers and Fluids, vol. 112, May 2, 2015, pp. 108-115.

Sherif et al. (2015) Rheological behavior of oil-based drilling foams, Journal of Natural Gas Science and Engineering, vol. 26, pp. 873-882.

Spriggs et al. (2008) MPD planning: How much is enough?, Blade Energy Partners, SPE/IADC 113682, Society of Petroleum Engineers—SPE/IADC Managed Pressure Drilling and Underbalanced Operations Conference and Exhibition 2008, pp. 1-8.

Vavik et al. (2016) Loss of Circulation an Indication of Hydrocarbon Influx?, SPE/IADC-179712-MS, Society of Petroleum Engineers—SPE/IADC Managed Pressure Drilling and Underbalanced Operations Conference and Exhibition Conference Paper—2016, pp. 1-14.

* cited by examiner

FOAM CAP DRILLING METHODS

CROSS REFERENCE TO RELATED APPLICATIONS

This application claims the priority of U.S. Provisional Application Ser. No. 62/690,672, filed Jun. 27, 2018 and U.S. Provisional Application Ser. No. 62/662,454, filed Apr. 25, 2018, the disclosures of which are incorporated herein by reference in their entireties.

BACKGROUND

In a typical drilling operation in the oil and gas industry, a borehole or wellbore is created by penetrating the earth with a drill bit and accessing hydrocarbon-bearing subterranean formations. The drill bit is arranged at the end of a drill string extended from a drilling rig, and the drill bit is rotated to advance toward the subterranean formations. While drilling, a drilling fluid or "mud" is commonly pumped downhole through the drill string to the drill bit. The drilling fluid exits the drill bit via one or more nozzles and helps cool the drill bit and circulate drill cuttings back to the surface via the annulus defined between the drill string and the inner wall of the wellbore.

Over time as the liquid hydrocarbons in the subterranean formations are depleted, the reservoir pressure can fall below bubble point (BBP), at which point gases may start to precipitate out of liquid suspension. When such subterranean formations are penetrated by a drill bit, the circulating drilling fluid may flow into subterranean formation instead of returning to the surface via the annulus. The drilling fluid can be "lost" as it progressively fills the formation, which reduces the hydrostatic column pressure within the annulus. To avoid wasting valuable drilling fluid, a driller may stop circulating the drilling fluid and instead inject a sacrificial fluid (e.g., water) through the drill string.

As the drilling fluid column in the annulus begins to drop, the liberated gases may enter the annulus. Moreover, as the sacrificial fluid flows into the subterranean formation, buoyancy forces may also urge the accumulated reservoir gas out of the subterranean formation and into the annulus. Once the hydrostatic pressure within the annulus drops below the reservoir pressure, the reservoir gases may start migrating toward the surface and a "kick" may ensue at the surface. Unless the flow path in the annulus is obstructed, the accumulated gases will communicate to the surface, which can result in dangerous surface conditions.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to drilling operations in the oil and gas industry and, more particularly, to preventing the migration of reservoir gases to surface by injecting a foam into the annulus defined between the drill string and the wellbore wall.

Embodiments disclosed herein describe a well system and methods of conducting a wellbore operation to mitigate or prevent reservoir gas migration to a surface location. One example method includes drilling a wellbore through one or more hydrocarbon-bearing subterranean formations, whereby an annulus may be defined between the drill string and an inner wall of the wellbore. To help prevent migration of gases from the one or more subterranean formations to a surface location via the annulus, a foam may be generated with a foam generator of an annular injection system in communication with the annulus. The generated foam may be introduced into the annulus with the annular injection system. The foam may help maintain a hydrostatic cap in the annulus to confine the gases within the wellbore.

The presently described systems and methods may replace conventional drilling practices in situations of severe lost returns and when a mud cap or a pressurized mud cap drilling (PMCD) method might alternatively be employed. Moreover, embodiments of the present disclosure are dissimilar to conventional foam drilling operations, which normally do not involve drilling reservoir sections in the presence of hydrocarbons. In contrast to conventional foam drilling where foam is conveyed downhole via the drill string, embodiments described herein discuss introducing foam directly into the annulus. Furthermore, conventional foam drilling operations usually vent to the surface while simultaneously carrying cuttings from the wellbore. In contrast, injecting the foam directly into the annulus, as presently described herein, may prevent or substantially prevent reservoir gases from migrating to the surface via the annulus.

Figure 1:
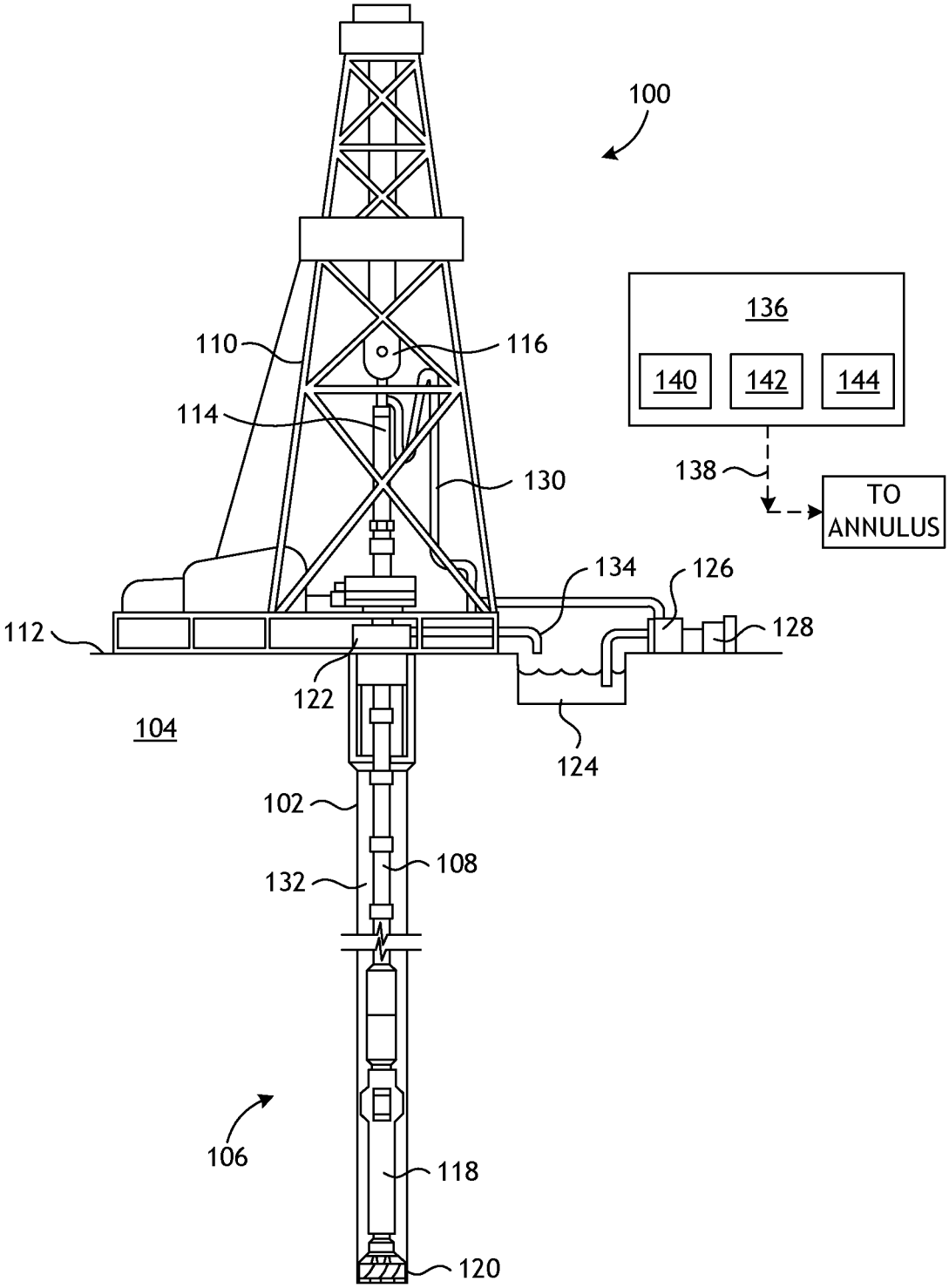
FIG. 1 is an example drilling system that may employ one or more principles of the present disclosure.

Referring to FIG. 1, illustrated is an example drilling system 100 that may employ one or more principles of the present disclosure. The drilling system 100 may be used to create a wellbore 102 by drilling into the earth 104. The drilling system 100 may be configured to drive a bottom hole assembly (BHA) 106 arranged at the bottom of a drill string 108 extended into the earth 104 from a drilling rig 110 (e.g., a derrick) arranged at the surface 112. In some applications, the drilling rig 110 can include a kelly 114 and a traveling block 116 used to lower and raise the kelly 114 and the drill string 108. In some embodiments, however, the kelly 114 may be replaced with a top drive or the like.

The BHA 106 may form an integral extension or portion of the drill string 108, and may include a tool string 118 and a drill bit 120 operatively coupled to the end of the tool string 118. During operation, the drill bit 120 is rotated to progressively penetrate subterranean formations residing in the earth 104 and thereby create the wellbore 102. In some embodiments, the BHA 106 may provide directional control of the drill bit 120 as it advances into the earth 104. For example, the tool string 118 may include various measurement tools (not shown) such as, but not limited to, measurement-while-drilling (MWD) and logging-while-drilling (LWD) tools, that may be configured to monitor and report downhole measurements of drilling conditions.

At the surface 112, the drill string 108 may extend through a wellhead 122 and into the wellbore 102 below. The wellhead 122 may be configured to maintain pressure within the wellbore 102 while simultaneously allowing the drill string 108 to rotate. The wellhead 122 may comprise, for example, a rotating control device (RCD), a blowout preventer (BOP), or a combination of the two.

During drilling operations, a drilling fluid or "mud" from a mud tank 124 may be pumped downhole using a mud pump 126 powered by an adjacent motor 128. The drilling fluid may be pumped from the mud tank 124, through a standpipe 130, which feeds the drilling fluid to the drill bit 120 through the drill string 108. The drilling fluid exits the drill bit 120 at one or more nozzles (not shown) and in the process cools the drill bit 120. After exiting the drill bit 120, the drilling fluid circulates back to the surface 112 via an annulus 132 defined between the inner wall of the wellbore 102 and the drill string 108 and simultaneously returns drill cuttings and debris to the surface 112. The cuttings and drilling fluid mixture are passed through a flow line 134 and are processed such that a cleaned drilling fluid is returned downhole through the standpipe 130 once again.

Although the drilling system 100 is shown and described with respect to a land-based drilling system, those skilled in the art will readily appreciate that many types of drilling systems can be employed in carrying out embodiments of the disclosure. For instance, the principles of the present disclosure may be applicable to both onshore and offshore drilling rigs. Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

The present disclosure describes a drilling method and system that may be used for drilling low-pressure, hydrocarbon-bearing formations (reservoirs) where lost returns inhibit the ability to maintain a liquid column within the annulus 132 to the surface 112. More particularly, embodiments described herein help maintain pressure balance when low-pressure subterranean formations are penetrated during drilling and when the reservoir pressure falls below bubble point (BBP) such that gases may be liberated from the hydrocarbons in the subterranean formation. When such subterranean formations are penetrated by the drill bit 120, the hydrostatic column pressure within the annulus 132 may be reduced as the circulating drilling fluid flows into the subterranean formation(s) instead of returning to the surface 112 via the annulus 132. In some scenarios, the pumped drilling fluid may progressively fill the subterranean formation(s), at which point a less expensive sacrificial fluid (e.g., water) may instead be pumped downhole to fill the subterranean formation(s). As the sacrificial fluid fills the subterranean formation(s), however, gases accumulated in the subterranean formation(s), such as methane and hydrogen sulfide ($H_2S$), may migrate into the annulus 132, further reducing the hydrostatic column pressure within the annulus 132. Unless the annulus 132 is obstructed, these migrating gases may communicate to the surface 112 via the annulus 132, which can result in dangerous conditions at the surface 112.

To help prevent the migration of gases to the surface 112, the drilling system 100 may include an annular injection system 136 configured to design, generate, and introduce a foam 138 into the annulus 132 to maintain a hydrostatic cap in the annulus 132 that confines the liberated gases. The foam 138 may be made from a plurality of constituents including, but not limited to, a gas, a liquid, and a surfactant. The gas constituent may comprise, for example, air, nitrogen, or carbon dioxide ($CO_2$). The liquid constituent may comprise, for example, water, diesel, or crude oil (e.g., reservoir oil). The surfactant reduces the surface tension to allow bubbles in the foam 138 to remain inflated.

In some embodiments, one or more polymer additives (e.g., a stabilizer, a viscosifier, etc.) may be added to the foam 138 to increase the viscosity of the foam 138 and thereby increase its stability. In other embodiments, or in addition thereto, the foam 138 may further include nanoparticles to develop a targeted rheology. In at least one embodiment, for example, nanoparticles in the form of carbon nanotubes may be included in the foam 138.

The foam 138 may exhibit properties that can successfully inhibit or mitigate gas migration. More specifically, the foam 138 can have a high viscosity and may thus be a suitable candidate to prevent migration of gas by essentially sealing the annulus 132 like a plug. The high apparent viscosity may also reduce drainage (leakage) of the foam 138 into the subterranean formation(s). In contrast, injecting a liquid or a gas into the annulus 132 may not adequately stop gas migration. If a liquid (e.g., water, diesel, etc.) is pumped into the annulus 132, for instance, the liquid may simply drain into the subterranean formation(s) and require large pumping volumes and flow rate to prevent gas bubble rise due to gas/liquid swapping. If a gas (e.g., nitrogen, carbon dioxide, etc.) is instead pumped into the annulus 132, the gas may not have sufficient hydrostatic pressure to balance the reservoir pressure, which would require the gas pressure at the wellhead 122 to be dramatically increased to ensure that the pressure downhole is high enough to balance the reservoir pressure.

The annular injection system 136 may be automated or may allow a user to manually make the alterations described herein. In some embodiments, the annular injection system 136 may include a foam generator 140 configured to generate the foam 138 by shearing (mixing, agitating, etc.) the constituents. The foam generator 140 may alternately be referred to as a "shearing mechanism" or a "high shear device." While conventional foam drilling operations generate foam downhole, the foam generator 140 may be located at the surface 112 and the foam 138 may thus be generated outside of the wellbore 102. In other embodiments, however, the foam 138 may alternatively be generated downhole within the wellbore 102, without departing from the scope of the disclosure.

In some embodiments, the annular injection system 136 may further include a pump 142 used to continuously or intermittently pump (inject) the foam 138 into the annulus 132. Accordingly, the pump 142 may be communicably coupled to the annulus 132, either directly or indirectly. In one embodiment, for example, the pump 142 may be fluidly coupled to the flow line 134, which communicates with the annulus 132. In other embodiments, the pump 142 may be coupled to the wellhead 122, which communicates with the annulus 132. In yet other embodiments, the pump 142 may be directly coupled to the annulus 132 below the wellhead 122. In further embodiments, the foam 138 may be introduced into the annulus 132 via the drill string 108 or a separate injection line, without departing from the scope of the disclosure.

The foam 138, however, may be introduced downhole via other means besides using the pump 142. In some embodiments, for example, the foam 138 may be generated through a chemical reaction where the necessary constituents are supplied downhole through the annulus 132, the drill string 108, one or more fluid lines (pipes), or any combination thereof. Once introduced and combined downhole, the constituents may react to create the foam 138. In other embodiments, the foam 138 may be sprayed into the annulus 132 with one or more nozzles that serve to shear, mix, and/or agitate the constituents to create the foam 138.

The annular injection system 136 may also include a computer system 144 configured to control and operate the annular injection system 136. The computer system 144 may include computer hardware used to implement the various algorithms described herein and can include a processor (e.g., a microprocessor) configured to execute one or more sequences of instructions, programming stances, or code stored on a non-transitory, computer-readable medium. The computer system 144 may control operation of the foam generator 140 to output the foam 138 at a predetermined (preferred) chemistry and/or rheology. Moreover, the computer system 144 may also control operation of the pump 142 to ensure proper pumping flow rates and pressure to maintain the foam 138 at the predetermined rheological properties.

Figure 2:
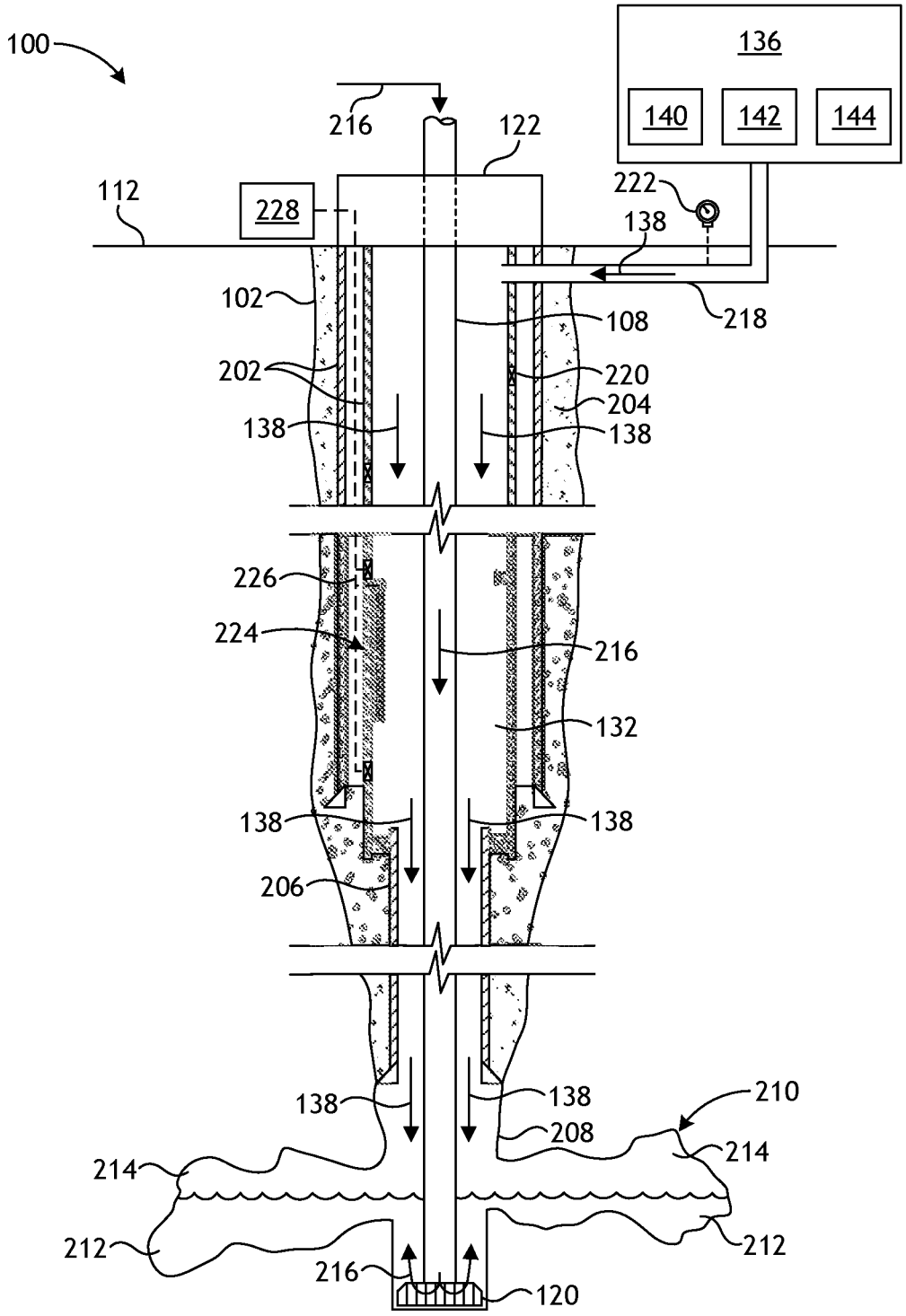
FIG. 2 is an enlarged schematic view of a portion of the drilling system of FIG. 1.

FIG. 2 is an enlarged schematic view of a portion of the drilling system 100 of FIG. 1, according to one or more embodiments. In the illustrated embodiment, the wellbore 102 may be at least partially lined with one or more strings of casing 202 secured in place with cement 204. The casing 202 may generally extend from the wellhead 122 at the surface 112, and one or more of wellbore liners 206 (one shown) may extend from or be "hung off" the casing 202. The annulus 132 may be defined between the drill string 108 and an inner wall of the wellbore 102, the casing 202, and/or the liner 206 (collectively referred to herein as the "inner wall of the wellbore").

In the illustrated embodiment, the wellbore 102 extends from the bottom-most wellbore liner 206 and provides an open-hole section 208 where the drill bit 120 has penetrated one or more hydrocarbon-bearing subterranean formations 210. It should be noted that while only one subterranean formation 210 is depicted in FIG. 2, it is contemplated herein to advance the drill bit 120 to penetrate a plurality of subterranean formations 210 before or while implementing the systems and methods described herein. In some embodiments, the subterranean formations 210 may comprise vugular formations that include large pores, but may also include hydrocarbon-bearing cavities, caves, caverns, etc.

As illustrated, the subterranean formation 210 may contain liquid hydrocarbons 212 and gases 214 that have precipitated out of liquid suspension and are otherwise separated from the liquid hydrocarbons 212. The gases 214 may have precipitated out of the liquid hydrocarbons 212 when the reservoir pressure falls below bubble point (BBP). The gases 214 may comprise, for example, methane and $H_2S$, but may include other gases.

Once the subterranean formation 210 has been penetrated, drilling fluid circulated through the drill string 108 may become "lost" as it flows into the subterranean formation 210 instead of returning to the surface 112 via the annulus 132. As a result, the column of drilling fluid within the annulus 132 may also drop as the drilling fluid returns drain into the subterranean formation 210. When it is determined that the drilling fluid is being lost, such as when the drilling fluid loss rate exceeds a threshold value, drilling operations may cease and a less-expensive sacrificial fluid 216 may instead be conveyed downhole via the drill string 108. The sacrificial fluid 216 may comprise, for example, water, such as fresh water, seawater, or brine. The sacrificial fluid 216 is ejected from the drill bit 120 via the nozzles (not shown) and may then proceed to fill the subterranean formation 210.

As the drilling fluid level in the annulus 132 falls, the hydrostatic pressure acting on the gases 214 in the subterranean formation 210 will correspondingly decrease. Once this hydrostatic pressure drops below the reservoir pressure the gases 214 may commence migrating toward the surface 112 within the annulus 132. Moreover, progressively filling the subterranean formation 210 with the drilling fluid and/or the sacrificial fluid 216 may urge the gases 214 out of the subterranean formation 210 and into the annulus 132 by buoyancy.

To prevent the gases 214 from migrating to the surface 112 via the annulus 132, the annulus 132 may be closed and the annular injection system 136 may be operated to introduce (e.g., inject, pump, etc.) the foam 138 into the annulus 132. In the illustrated embodiment, the annular injection system 136 is fluidly coupled to the annulus 132 via a flow line 218. In some embodiments, the flow line 218 may be the same as or similar to the flow line 134 of FIG. 1. In other embodiments, however, the flow line 218 may be coupled to the wellhead 122. In yet other embodiments, as illustrated, the flow line 218 may communicate directly with the annulus 132 below the wellhead 122. In further embodiments, as discussed above, the foam 138 may be introduced into the annulus 132 via the drill string 108 or a separate injection line, or the foam 138 may alternatively be introduced downhole via other means besides using the pump 142, such as through a downhole chemical reaction or via spraying the foam 138 into the annulus 132.

In the illustrated embodiment, however, the foam 138 may be generated at the surface 112 using the foam generator 140, as operated by the computer system 144. The foam 138 may then be continuously or intermittently pumped (introduced) into the annulus 132 using the pump 142, as also operated by the computer system 144. As with all general types of foams, the foam 138 may be naturally unstable, and without the introduction of energy, the foam 138 may tend to separate into gas and liquid. Accordingly, when the foam 138 becomes unstable, the supply may be replenished by pumping additional foam 138 into the annulus 132. This may be done either continuously or intermittently, or otherwise as needed.

In some embodiments, one or more sensors 220 (one shown) may be positioned within the wellbore 106 at a predetermined location (depth). The sensor(s) 220 may be communicably coupled (wired or wirelessly) to the annular injection system 136 and, more particularly, to the computer system 144. The sensor(s) 220 may be configured to monitor conditions within the annulus 132 and communicate detection signals to the computer system 144 for processing. In one or more embodiments, for example, the sensor(s) 220 may be configured to detect the gases 214 and alert the computer system 144 when the gases 214 have reached the sensor 220. Upon detecting the presence of the gases 214, the computer system 144 may be programmed to trigger operation of the foam generator 140 and the pump 142 to generate and pump (introduce) additional foam 138 into the annulus 132 to suppress the gases 214.

In some embodiments, the pump rate of the pump 142 (alternately referred to as the "foam introduction rate") may be altered (adjusted) to maintain a desired consistency of the foam 138 and/or maintain a desired surface pressure at or near the wellhead 122 to thereby maintain a hydrostatic cap within the annulus 132 to confine the liberated gases 214. In such embodiments, one or more pressure sensors 222 (one shown) may be configured to monitor the pressure within the annulus 132 and send a signal to the annular injection system 136 when the pressure reaches a predetermined pressure limit. The pressure sensor(s) 222 may be positioned within the flow line 218, as illustrated, but could alternatively be positioned within the wellbore 102. The predetermined pressure limit may be, for example, a predetermined pressure below the pressure threshold of the wellhead 122. In other embodiments, the predetermined pressure limit may be a threshold pressure for the chemistry of the foam 138, below which the foam 138 may tend to destabilize (separate). When the predetermined pressure limit is reached, as detected by the pressure sensor(s) 222, the computer system 144 may be programmed to alter the pump rate of the pump 142 to bring the pressure within acceptable limits. In other embodiments, or in addition thereto, when the predetermined pressure limit is reached, as detected by the pressure sensor(s) 222, the computer system 144 may be programmed to modify (alter) the chemistry of the foam 138 for introduction into the annulus 132.

The behavior and hydraulics of the foam 138 can be complex. In general, foams are compressible fluids with a non-Newtonian rheology. Among other parameters, foam is generally characterized by its quality (e.g., the ratio of gas volume to total volume) and half-life. When the foam 138 quality is too high (e.g., around 99% gas) it may destabilize into a mist. In contrast, when the foam 138 quality is too low (e.g., around 40% gas) it may destabilize into gas and liquid slugs. Moreover, the rheological properties of the foam 138 may change depending on the pressure, temperature, and quality of the foam 138, which may depend on the depth within the wellbore 102. More specifically, as the depth of the wellbore 102 increases, the foam 138 in the annulus 132 becomes progressively compressed, which increases the density of the foam 138. Thus, the foam 138 may exhibit a non-linear density and pressure profile under static conditions. In contrast, the viscosity of the foam 138 may increase as the density decreases, which is counter intuitive behavior where lighter foams are more viscous. Further, as well depth increases, the temperature increases and may cause the foam 138 to expand.

To account for the above-described complex behavior of the foam 138, the computer system 144 may include and otherwise be programmed to apply a hydraulics model that optimizes the chemistry and/or rheology of the foam 138 for varying well and operating parameters. Basic well and operating parameter inputs that may be provided to the hydraulics model include, but are not limited to, the profile or "wellpath" of the wellbore 102, the hole and casing sections, the chemistry and rheology of the foam 138 across a spectrum of temperatures and pressures, gas and liquid flow rates at the surface 112, reservoir pressure, the back pressure or choke pressure of the annulus 132, the geothermal temperature profile of the wellbore 102, or any combination thereof. Based on the well parameter and operating inputs and the known hydraulic behavior of the foam 138, the annular injection system 136 may be capable of generating and injecting the foam 138 with chemistry and/or rheology best suited for the current state of the well.

The hydraulics model may take into account the above-described characteristics of the foam 138 to primarily predict the pressure, the density, and the quality profile of the foam 138 required along the annulus 132 from the surface 112 to the drill bit 120 in a static mode and/or a dynamic mode. In a dynamic mode, for example, the hydraulics model may help predict the gas and liquid rates that need to be injected at the surface 112 to generate an optimized foam 138. In some embodiments, the hydraulics model may comprise a one-dimensional transient model that may consist of discretizing (representing or approximating) the annulus 132 and solving the mass, momentum, and energy conservation equations in each discrete element of the wellbore 102. The quality and rheology of the foam 138 may be captured through various constitutive models, where the governing equation may be hyperbolic for which there exists various numerical approaches (e.g., Riemann solver, backward difference, etc.). The performance and stability of a particular numerical method may guide the decision on which numerical approach to implement. As will be appreciated by those skilled in the art, various modifications to well-known numerical methods may be undertaken to better suit the specifics of these calculations.

As needed, the hydraulics model may also be based on other well parameter and operating inputs. In some embodiments, for example, the hydraulics model may also be based on tracked pressure waves traveling up and down the annulus 132 (e.g., kick detection). In other embodiments, or in addition thereto, the hydraulics model may be based on the effects of fluid loss to the subterranean formation(s) 210 and the effects of fluid gain from the reservoir. In yet other embodiments, or in addition thereto, the hydraulics model may be based on the gas solubility of the foam 138, the contamination and degradation of the foam 138, the recorded half-life of the foam 138, or any combination thereof.

The hydraulics model may be designed such that the chemistry and/or rheology of the foam 138 may be stable for the range of temperatures and pressures that the foam 138 will likely encounter within the annulus 132, and may further be stable over a wide range of quality (e.g., between about 40% and about 99% gas) to accommodate different well depths and maintain low pressures at the wellhead 122. The hydraulics model may be designed such that the chemistry and/or rheology of the foam 138 may be able to mitigate gas 214 migration at portions of the wellbore 102 that have high angles. The hydraulics model may also be designed such that the chemistry of the foam 138 may be stable in the presence of reservoir gases like $H_2S$ and have a high half-life that does not degrade quickly, which would otherwise require high pumping rates. The hydraulics model may also be designed such that the chemistry of the foam 138 may be compatible with elastomers, reservoir fluids, or other environmental elements that may be found in the well system 100. The hydraulics model may also be configured to capture the effect of drill pipe rotation on the foam 138.

The results of the hydraulics model may also help influence the choice of surface equipment, such as the foam generator 140, the pump 142, and the wellhead 122.

Accordingly, the chemistry and/or rheology of the foam 138 (e.g., the percent of the constituent parts) may be optimized and otherwise altered based on at least the depth, the fluid pressure, and the temperature of the wellbore 102. Since the foam 138 will react differently at different wellbore 102 depths, pressures, and temperatures, the foam 138 may be specifically generated to align with the known depth, pressure, and temperature of the wellbore 102. The foam 138 may thus be created to be viscous enough to stop the upward progression or migration of the encountered subsurface gases 214 within the annulus 132. E.g., migration counter to (uphole) the direction of travel of the foam within the annulus (downhole). The foam may also be designed and created to be viscous enough to maintain mud cake and wellbore wall stability during drilling. By nature, the foam 138 is viscous because the bubbles of the foam 138 having a desired surface tension and touching each to maintain cohesiveness sufficient to inhibit relative movement with respect to each other. Thereby, the foam at least in part creates a viscosity effect. Once the foam 138 becomes pressurized, however, such as at relatively deep depths in the wellbore 102, the gas bubbles may start to shrink and may get small enough that they fail to touch each other. At this point, the liquid and gas constituents of the foam 138 start to separate as the liquid continuous phase of the foam occupies relatively more volume than the gas phase and viscosity may diminish. Although not always necessary, if desired, the foam chemistry, fluid choices, and physical generation mechanism and mixing energy, shearing, etc., may be tailored to the specific application. Routine lab experimentation may be used to dial in the desired foam properties. As one objective is to prevent migration of potentially harmful formation gases up the wellbore annulus, it may not be necessary that the foam exist as a "foam state" along the entire length of the annular wellbore. By acting as a foam "cap" in at least the upper reaches of the wellbore, annular gas migration often may be halted and contained within the annulus, at a depth safely distant from the wellbore surface. The foam cap may also be utilized to minimize drill pipe exposure to the formation gases to mitigate corrosion, such as hydrogen embrittlement and pitting. A corrosion inhibitor may be included within the foam fluid chemistry to mitigate corrosion if the migrating formation gases contain sufficient acidic, hydrogen, carbon dioxide, and/or sulfur content.

Introduction of the foam cap into the annulus is conducted below a closed drilling basket, annular blow-out preventer, or snubbing type pressure control apparatus, to confine the foam to the annulus. In addition to gravity, the closed upper end of the annulus forces foam down the annulus and serves to facilitate buildup of a pressurized hydraulic head in the annulus. Because the foam is introduced into the annulus with a closed upper end, (typically within or near top of the blow out preventor stack, but below the rotating head) the hydrostatic head created by the foam fluid alone is sufficient to create a "pressurized" annulus. However, the foam may be introduced into the annulus with a foam generator pump that thereby provides additional introduction pressure within the annulus, especially as necessary to overcome any gas migration or wellbore entry pressure within the annulus that the foam's hydrostatic does not overcome. Either way, (hydrostatic head and/or pump pressure) introduction of the foam into the annulus serves to "pressurize" the annulus sufficiently to halt gas migration and/or provide blowout wellbore control if necessary.

Based on the results of the hydraulics model, the chemistry and/or rheology of the foam 138 may be altered (optimized) to ensure that the foam 138 will hold proper foaming properties at elevated depths, pressures, and temperatures. For example, the chemistry and/or rheology of the foam 138 generated by the foam generator 140 may be altered by adding or removing foam constituents to ensure sufficient column pressure within the annulus 132 to stop the vertical progression of the gases 214. By adding more liquid, for example, the rheology of the foam 138 can be altered to reduce wellbore pressure assumed at the wellhead 122. By adding more gas, the rheology of the foam 138 can be altered to reduce the required pumping rates into the wellbore 102. Accordingly, the injected foam 138 may help inhibit the migration of the gases 214 and simultaneously manage pressures in the wellbore 102.

According to one or more embodiments, the foam 138 may be generated and its rheology subsequently measured using a rheometer. The resulting rheology data may be provided to the hydraulics model, together with one or more well parameter and operating inputs (e.g., temperature, reservoir pressures, depth, etc.). The quality of the foam 138 and pressure profile may then be determined under a static case. If the foam 138 is able to remain stable in the presence of the known well parameter and operating inputs, then the foam 138 may be introduced (e.g., pumped) downhole. However, if the foam 138 is unable to remain stable in the presence of the known well parameter and operating inputs, then a dynamic case may be modeled where required pumping rates, pressures, and foam quality are determined (predicted). If the modeled foam 138 in dynamic mode is able to remain stable in the presence of the known well parameter and operating inputs, then the modeled foam 138 may be generated and introduced (e.g., pumped) downhole. However, if the modeled foam 138 is unable to remain stable in the presence of the known well parameter and operating inputs, then a new foam may be designed with guidance from the previous modeling results. In some applications, the foregoing modeling may enable an operator to obtain an 80% foam formula and help define operational guidelines prior to experiments (small and large scale) and field testing.

Accordingly, the annular injection system 136 may be configured or otherwise designed to maintain a constant hydraulic pressure within the annulus 132 by introducing the foam 138 into the annulus 132 and regulating the foam introduction rate. Alternatively, or in addition thereto, constant hydraulic pressure within the annulus 132 may also be achieved by adjusting an annular choke included in the wellhead 122, where the annular choke operates to regulate hydraulic pressure within the annulus 132. Alternatively, or in addition thereto, constant hydraulic pressure within the annulus 132 may further be achieved by adjusting the quality (e.g., density) of the foam 138.

Once the gases 214 have been sufficiently capped (stopped) by the foam 138 within the annulus 132 and the drilling operations are completed, the drill string 108 may be progressively removed ("tripped") from the wellbore 102 in preparation for wellbore completion operations. As the drill string 108 is pulled from the wellbore 102, additional foam 138 may be pumped into the annulus 132 from the annular injection system 136 to keep the reservoir gases 214 from migrating uphole.

Once the drill bit 120 is reversed past a predetermined location in the wellbore 102, a wellbore isolation device 224 may be actuated to close off communication within the wellbore 102. In the illustrated embodiment, the wellbore isolation device 224 is incorporated into or otherwise coupled to the casing 202 but may alternatively be positioned in the wellbore liner 206, without departing from the scope of the disclosure. In some embodiments, the wellbore isolation device 224 may comprise one or more flapper valves actuatable to isolate the downhole portions of the wellbore 102. In other embodiments, however, the wellbore isolation device 224 may comprise any other device or mechanism capable of closing off the wellbore 102 and preventing fluid communication to the surface 112.

One or more control lines 226 may extend from the surface 112 to communicate with and operate the wellbore isolation device 224. The control line 226 may include, for example, one or more hydraulic, electrical, or fiber optic lines. At the surface 112, the control line 226 may be communicably coupled to an operations module 228. In at least one embodiment, the operations module 228 may form part of the computer system 144. In other embodiments, however, the operations module 228 may comprise a separate operational system configured to regulate operation of the wellbore isolation device 224 and any other component systems communicably coupled thereto.

Figure 3:
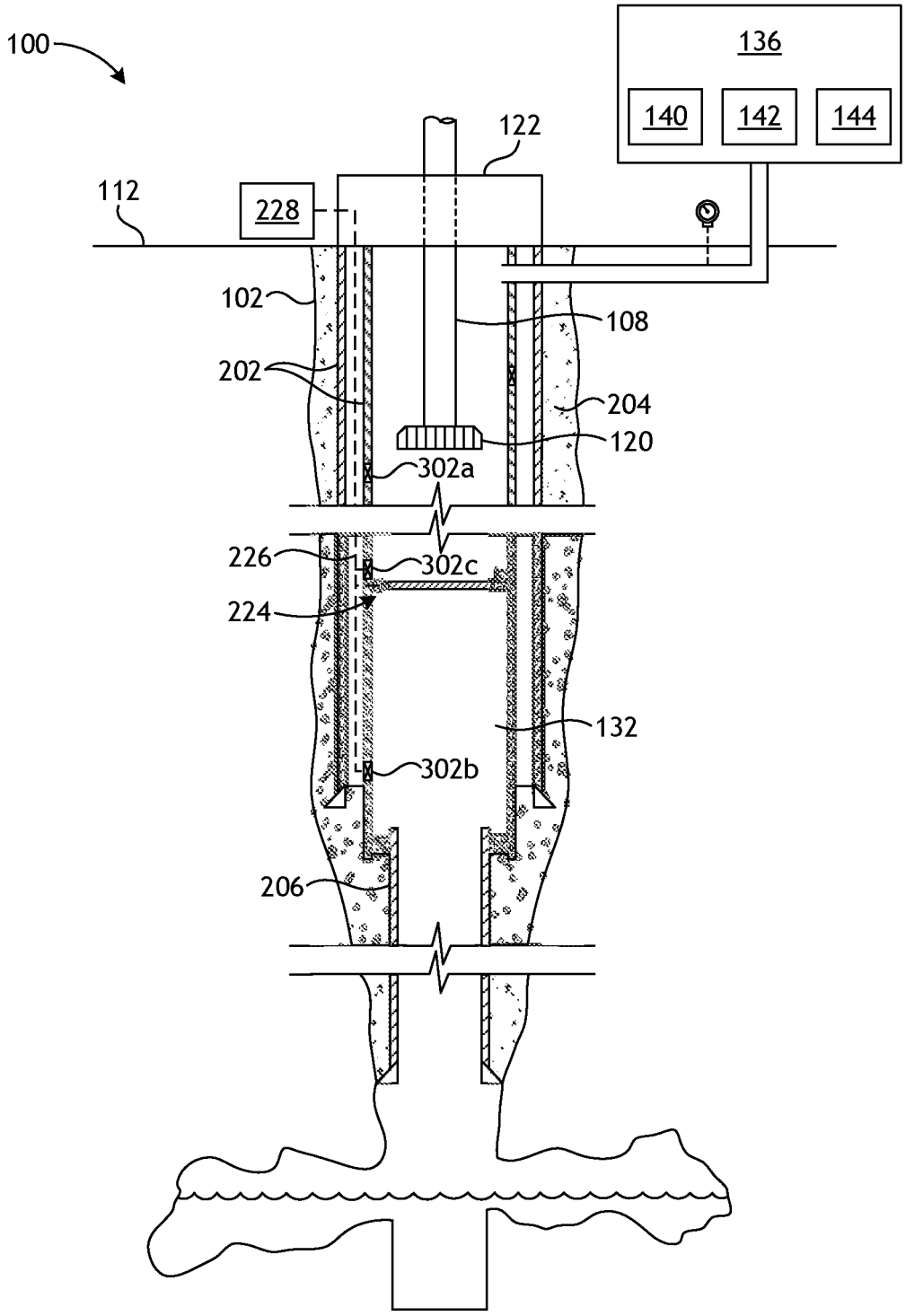
FIG. 3 is an enlarged schematic view of a portion of the drilling system of FIG. 1 showing the drill bit reversed uphole.

FIG. 3 is an enlarged schematic view of a portion of the drilling system 100 showing the drill bit 120 reversed uphole. More specifically, the drill bit 120 is depicted as having bypassed the wellbore isolation device 224, which is depicted in the closed position to isolate the downhole portions of the wellbore 102. Once the wellbore isolation device 224 is closed, the upper portions of the wellbore 102 may be circulated within the casing 202 to flush any remnant fluids and debris out of the wellbore 102. Flushing the wellbore 102 may also ensure that no harmful gases are in the return stream. Any foam 138 (FIG. 2) remaining in the annulus 132 above the wellbore isolation device 224 may also be returned to the surface during circulation and separated for subsequent use.

In some embodiments, one or more sensors may also be arranged within the wellbore 102 to sense the location of the drill bit 120 and/or monitor environmental conditions (e.g., pressure, temperature, chemical composition of the wellbore fluids, etc.) within the annulus 132. In the illustrated embodiment, for example, the drilling system 100 may include at least a first sensor 302*a*, a second sensor 302*b*, and a third sensor 302*c*. The first sensor 302*a* may be arranged uphole from the wellbore isolation device 224, the second sensor 302*b* may be arranged downhole from the wellbore isolation device 224, and the third sensor 302*c* may be arranged at an intermediate location between the first and second sensors 302*a,b*.

In some embodiments, the first and second sensors 302*a,b* may be used to monitor a pressure differential across the wellbore isolation device 224. When it is desired to re-enter the lower portions of the wellbore 102, the first and second sensors 302*a,b* may monitor and report when the pressure differential across the wellbore isolation device 224 has been reduced to a predetermined limit where the wellbore isolation device 224 may be safely opened. In some embodiments, the third sensor 302*c* may be used to sense the location of the drill bit 120. Once the third sensor 302*c* detects the proximity of the drill bit 120, the wellbore isolation device 224 may be closed to isolate the lower portions of the wellbore 102.

Each of the sensors 302*a-c* may be in communication with the control line 226 to be able to communicate with the surface 112. In other embodiments, however, the control line 226 may be omitted and the wellbore isolation device 224 and the sensors 302*a-c* may communicate with the surface 112 via known wireless means.

Embodiments Disclosed Herein Include:

A. A method for conducting a wellbore operation includes drilling a wellbore through one or more hydrocarbon bearing subterranean formations with a drill bit arranged at an end of a drill string, wherein an annulus is defined between the drill string and an inner wall of the wellbore, generating a foam with a foam generator of an annular injection system in communication with the annulus, and introducing the foam into the annulus with the annular injection system.

B. A drilling system that includes a drill string extendable into a wellbore that penetrates one or more subterranean formations, wherein an annulus is defined between the drill string and an inner wall of the wellbore, and an annular injection system communicably coupled to the annulus and including a foam generator that generates a foam to be introduced into the annulus and thereby prevent migration of gases originating from the one or more subterranean formations to a surface location via the annulus.

Each of embodiments A and B may have one or more of the following additional elements in any combination: Element 1: further comprising closing the annulus at a surface location, and pressurizing the annulus by introducing the foam into the annulus. Element 2: further comprising closing the annulus at a surface location, and maintaining a constant hydraulic pressure within the annulus by introducing the foam into the annulus and at least one of i) regulating a foam introduction rate, ii) adjusting an annular choke that regulates hydraulic pressure within the annulus, and iii) adjusting a quality of the foam. Element 3: further comprising pumping a sacrificial fluid through the drill string as the foam is introduced into the annulus. Element 4: preventing migration of gases from the one or more subterranean formations to a surface location with the foam. Element 5: further comprising detecting migration of the gases at a known location within the wellbore, and introducing additional foam into the annulus when the gases are detected at the known location. Element 6: further comprising measuring a pressure within the annulus with one or more sensors, and altering a chemistry of the foam based on measurements obtained by the one or more sensors. Element 7: wherein the annular injection system further includes a pump and the method further comprises pumping the foam into the annulus with the pump, and altering a pump rate of the pump to maintain at least one of i) a desired consistency of the foam, ii) a desired a desired quality of the foam, and iii) a desired surface pressure at a surface location. Element 8: further comprising altering a pump rate of the pump to maintain a desired surface pressure at a surface location. Element 9: further comprising optimizing one or both of a chemistry and a rheology of the foam based on at least one of i) a depth of the wellbore, ii) a pressure within the wellbore, and iii) a temperature within the wellbore. Element 10: further comprising pulling the drill string out of the wellbore, and pumping additional foam into the annulus as the drill string is pulled from the wellbore. Element 11: further comprising actuating a wellbore isolation device positioned within the wellbore once the drill bit bypasses a predetermined location in the wellbore, and circulating a fluid through the wellbore uphole from the wellbore isolation device and thereby flushing the wellbore.

Element 12: wherein the annular injection system is fluidly coupled to a flow line that communicates with the annulus. Element 13: further comprising a wellhead arranged at the surface location, wherein the flow line is directly coupled to the annulus below the wellhead. Element 14: wherein the annular injection system further includes a pump operable to pump the foam into the annulus. Element 15: wherein one or both of a chemistry and a rheology of the foam is optimized based on at least one of a depth of the wellbore, a pressure within the wellbore, and a temperature within the wellbore. Element 16: further comprising casing that lines the wellbore, and a wellbore isolation device secured to the casing and actuatable to isolate lower portions of the wellbore. Element 17: further comprising a first sensor arranged within the wellbore uphole from the wellbore isolation device, and a second sensor arranged within the wellbore downhole from the wellbore isolation device, wherein the first and second sensors monitor a pressure differential across the wellbore isolation device. Element 18: wherein the annular injection system is automated or manually operable.

By way of non-limiting example, exemplary combinations applicable to A and B include: Element 2 with Element 6; Element 2 with Element 7; Element 2 with Element 8; Element 4 with Element 5; Element 7 with Element 8; Element 10 with Element 11; Element 12 with Element 13; Element 16 with Element 17; Element 12 with Element 18; and Element 13 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, to B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A method for conducting a wellbore operation, comprising:

drilling a wellbore through one or more hydrocarbon bearing subterranean formations with a drill bit arranged at an end of a drill string, wherein an annulus is defined between the drill string and an inner wall of the wellbore;

generating a foam with a foam generator of an annular injection system in communication with the annulus; and introducing the foam into the annulus with the annular injection system, wherein the introducing the foam is performed to confine fluids within the wellbore without removing the foam and cuttings from the wellbore during the performance of the introducing.

2. The method of claim 1, further comprising:

closing the annulus at a surface location; and pressurizing the annulus by introducing the foam into the annulus.

3. The method of claim 1, further comprising:

closing the annulus at a surface location; and maintaining a constant hydraulic pressure within the annulus by introducing the foam into the annulus and at least one of i) regulating a foam introduction rate, ii) adjusting an annular choke that regulates hydraulic pressure within the annulus, and iii) adjusting a quality of the foam.

4. The method of claim 1, further comprising pumping a sacrificial fluid through the drill string as the foam is introduced into the annulus.

5. The method of claim 1, further comprising preventing migration of gases from the one or more subterranean formations to a surface location with the foam.

6. The method of claim 5, further comprising:

detecting migration of the gases at a known location within the wellbore; and introducing additional foam into the annulus when the gases are detected at the known location.

7. The method of claim 1, further comprising:

measuring a pressure within the annulus with one or more sensors; and altering a chemistry of the foam based on measurements obtained by the one or more sensors.

8. The method of claim 1, wherein the annular injection system further includes a pump and the method further comprises:

pumping the foam into the annulus with the pump; and altering a pump rate of the pump to maintain at least one of i) a desired consistency of the foam, ii) a desired a desired quality of the foam, and iii) a desired surface pressure at a surface location.

9. The method of claim 8, further comprising altering a pump rate of the pump to maintain a desired surface pressure at a surface location.

10. The method of claim 1, further comprising optimizing one or both of a chemistry and a rheology of the foam based on at least one of i) a depth of the wellbore, ii) a pressure within the wellbore, and iii) a temperature within the wellbore.

11. The method of claim 1, further comprising:

pulling the drill string out of the wellbore; and pumping additional foam into the annulus as the drill string is pulled from the wellbore.

12. The method of claim 11, further comprising:

actuating a wellbore isolation device positioned within the wellbore once the drill bit bypasses a predetermined location in the wellbore; and circulating a fluid through the wellbore uphole from the wellbore isolation device and thereby flushing the wellbore.

13. A drilling system, comprising:

a drill string extendable into a wellbore that penetrates one or more subterranean formations, wherein an annulus is defined between the drill string and an inner wall of the wellbore; and an annular injection system communicably coupled to the annulus and including a foam generator that generates a foam to be introduced directly into the annulus and thereby prevent migration of gases originating from the one or more subterranean formations to a surface location via the annulus.

14. The drilling system of claim 13, wherein the annular injection system is fluidly coupled to a flow line that communicates with the annulus.

15. The drilling system of claim 14, further comprising a wellhead arranged at the surface location, wherein the flow line is directly coupled to the annulus below the wellhead.

16. The drilling system of claim 13, wherein the annular injection system further includes a pump operable to pump the foam into the annulus.

17. The drilling system of claim 13, wherein one or both of a chemistry and a rheology of the foam is optimized based on at least one of a depth of the wellbore, a pressure within the wellbore, and a temperature within the wellbore.

18. The drilling system of claim 13, further comprising:

casing that lines the wellbore; and a wellbore isolation device secured to the casing and actuatable to isolate lower portions of the wellbore.

19. The drilling system of claim 18, further comprising:

a first sensor arranged within the wellbore uphole from the wellbore isolation device; and a second sensor arranged within the wellbore downhole from the wellbore isolation device, wherein the first and second sensors monitor a pressure differential across the wellbore isolation device.

20. The drilling system of claim 13, wherein the annular injection system is automated.

* * * * *